US005695136A

United States Patent [19]

Rohdén et al.

[11] Patent Number: 5,695,136

[45] Date of Patent: Dec. 9, 1997

[54] REFINING ELEMENT

[75] Inventors: Lennart Rohdén, Enskede; Lars Obitz, Vaxholm, both of Sweden

[73] Assignee: Sunds Defibrator Industries AB, Sweden

[21] Appl. No.: 737,398

[22] PCT Filed: Jun. 26, 1995

[86] PCT No.: PCT/SE95/00779

§ 371 Date: Nov. 8, 1996

§ 102(e) Date: Nov. 8, 1996

[87] PCT Pub. No.: WO96/00616

PCT Pub. Date: Jan. 11, 1996

[30] Foreign Application Priority Data

Jun. 29, 1994 [SE] Sweden ..... 9402281

[51] Int. Cl.[6] ..... B02C 7/12

[52] U.S. Cl. ..... 241/261.3; 241/296; 241/297

[58] Field of Search ..... 241/261.2, 261.3, 241/296, 297, 298

[56] References Cited

U.S. PATENT DOCUMENTS

| | | | |
|---|---|---|---|
| 3,149,792 | 9/1964 | Textor | 241/261.3 |
| 4,039,154 | 8/1977 | Peterson | 241/261.3 |
| 4,166,584 | 9/1979 | Asplund | 241/261.3 |
| 4,423,845 | 1/1984 | Frazier et al. | 241/261.3 |
| 4,635,864 | 1/1987 | Peterson et al. | 241/251 |
| 4,712,745 | 12/1987 | Leith | 241/261.3 |
| 4,772,358 | 9/1988 | Virving | 241/261.3 X |
| 5,112,443 | 5/1992 | Virving et al. | 241/261.3 X |
| 5,181,664 | 1/1993 | Kohler | 241/261.3 |
| 5,248,099 | 9/1993 | Lahner et al. | 241/28 |
| 5,362,003 | 11/1994 | Virving | 241/261.3 |

FOREIGN PATENT DOCUMENTS

| | | |
|---|---|---|
| 0 172 830 | 9/1987 | European Pat. Off. . |
| 148560 B | 7/1983 | Norway . |
| 437226 B | 2/1985 | Sweden . |

*Primary Examiner*—John M. Husar

*Attorney, Agent, or Firm*—Lerner, David, Littenberg, Krumholz & Mentlik

[57] ABSTRACT

Apparatus for refining lignocellulose-containing material is disclosed including a pair of opposed refining disks defining a refining gap for the lignocellulose-containing material, at least one of the refining disks including an outer refining zone section which includes three refining zones including radially extending bars and corresponding radially extending grooves in which the first and third refining zones have a different bar density than the intermediate or second refining zone. Apparatus is also disclosed which includes a pair of opposed refining surfaces in which each disk refiner includes a pair of refining zones with one of each pair on each disk having a different bar density, and with the two zones being radially offset so that the like refining zones in each disk do not overlap with each other.

22 Claims, 1 Drawing Sheet

REFINING ELEMENT

FIELD OF THE INVENTION

The present invention relates to the disintegration and refining of lignocellulosic material in a disk refiner. More particularly, the present invention relates to a refining element for use in a refiner of that type.

BACKGROUND OF THE INVENTION

A disk refiner comprises two opposed refining discs, which are generally rotatable relative to each other, and where one or both of the disks are rotary. A plurality of refining elements arranged on the face of these refining disks form a pattern of bars and intermediate grooves. The refining disks are positioned so that the refining elements form a refining gap between the two refining disks, through which the fiber material is intended to pass outwardly from within. In this manner the disintegration of the lignocellulosic material is carried out by the bars of the refining elements.

The refining elements in the inner radial portion of the refining gap are generally formed with bars of a greater coarseness in order to carry out an initial disintegration, and to feed the material outwardly to the outer portion of the refining gap, where the disintegration and refining itself take place.

The refining of the material requires a large energy input, which is supplied by the rotation of the rotary refining disk or disks. The greatest portion of the energy is transformed to heat, as a result of which large amounts of steam are generated due to the water content in the material. The steam, substantially all of which is generated in the refining gap, has high pressure and flows both outwardly and inwardly in the refining gap.

To disintegrate and refine the fiber material by the bars of the refining elements, it is necessary in most cases to provide flow restrictions, or so-called dams, in the grooves between the bars. In this manner, the material is forced to move upwardly out of the grooves and to be worked between the bars in the refining gap. Unworked material is thus prevented from passing outwardly through the refining gap. These dams, however, obstruct the generated steam, which thereby disturbs the material flow, and has a negative effect on the capacity and operational stability of the refiner.

The aforesaid problems can be reduced by the present invention, which also offers additional advantages with regard to the quality of the refined material. According to the invention, co-operating refining elements on opposed refining disks are provided with radial zones, in which the bars are arranged in a denser or sparser relationship.

SUMMARY OF THE INVENTION

In accordance with the present invention, these and other objects have now been realized by the invention of apparatus for refining lignocellulose-containing material in a disk refiner comprising a pair of opposed relatively rotatable refining disks defining a refining gap for the lignocellulose-containing material therebetween. The apparatus includes a pair of refining disks including at least one refining disk comprising a refining disk surface including an inner refining zone section and an outer refining zone section disposed radially outwardly with respect to the inner refining zone section, the outer refining zone section including a first refining zone, a second refining zone disposed outwardly with respect to the first refining zone, and a third refining zone disposed outwardly with respect to the second refining zone, each of the first, second and third refining zones including a plurality of radially extending bars separated by a corresponding plurality of radially extending grooves, with the ratio of the bars to the grooves defining a bar density for each of the refining zones, the second refining zone having a first predetermined bar density and each of the first and third refining zones having a second predetermined bar density which is different from the first predetermined bar density. In a preferred embodiment, the second predetermined bar density is greater than the first predetermined bar density. In another embodiment, the second predetermined bar density is less than the first predetermined bar density.

In accordance with one embodiment of the apparatus of the present invention, the apparatus includes a fourth refining zone disposed radially outwardly with respect to the third refining zone, and a fourth refining zone having the first predetermined bar density. In a preferred embodiment, the second predetermined bar density is greater than the first predetermined bar density. In another embodiment, the second predetermined bar density is less than the first predetermined bar density.

In accordance with one embodiment of the present invention, the ratio of the width of the grooves in the first and third refining zones to the width of the grooves in the second refining zone is between about 1:1.25 and 1:1.75. Preferably, the ratio is about 1:1.5.

In accordance with another embodiment of the apparatus of the present invention, the ratio of the width of the grooves in the second refining zone to the width of the grooves in the first and third refining zones is between about 1:1.25 and 1:1.75, and preferably is about 1:1.5.

In accordance with another embodiment of the apparatus of the present invention, the radially extending grooves in the first and third refining zones have a first depth and the radially extending grooves in the second refining zone have a second depth, the first depth being less than the second depth. In another embodiment, however, the first depth is greater than the second depth. In a preferred embodiment, the ratio of the first depth to the second depth is between about 1:1 and 1:4.

In accordance with another embodiment of the apparatus of the present invention, the radially extending grooves in the first and third refining zones include a dam blocking the radially extending grooves, the dam comprising a maximum of one dam, and wherein the radially extending grooves in the second refining zone are free of any dam. In another embodiment, the radially extending grooves in the first and third refining zones and the radially extending grooves in the second refining zone are free of any dams.

In accordance with another embodiment of the apparatus of the present invention, apparatus is provided for refining lignocellulose-containing material in a disk refiner comprising a pair of opposed relatively rotatable refining disks defining a refining gap for the lignocellulose-containing material therebetween, the pair of refining disks including a first refining disk and a second refining disk, the first refining disk including an inner refining zone section and an outer refining zone section disposed radially outwardly with respect to the inner refining zone section, the outer refining zone section of the first refining disk including a first refining zone and a second refining zone disposed outwardly with respect to the first refining zone, the outer refining zone section of the second refining disk including a first refining zone and a second refining zone disposed outwardly with respect to the first refining zone, each of the first and second refining zones of the first and second refining disks including a plurality of radially extending bars and separated by a corresponding plurality of radially extending grooves defining a bar density for each of the refining zones, the first refining zone of the first and second refining disks having a first predetermined bar density and the second refining zone of the first and second refining disks having a second predetermined bar density, the first predetermined bar density being greater than the second predetermined bar density, and the first and second refining zones in the first refining disks being radially offset with respect to the first and second refining zones in the second refining disk so that the first refining zone in the first refining disk does not overlap with the first refining zone in the second refining disk.

In accordance with one embodiment of the apparatus of the present invention, the ratio between the width of the radially extending grooves in the first refining zones of the first and second refining disks to the width of the radially extending grooves in the second refining zone of the first and second refining disks is between about 1:1.15 and 1:1.75, and preferably is about 1:1.5.

In accordance with another embodiment of the apparatus of the present invention, the radially extending grooves in the first refining zones of the first and second refining disks have a first depth, and the radially extending grooves in the second refining zones of the first and second refining disks have a second depth, the first depth being less than the second depth. In a preferred embodiment, the ratio between the first and the second depth is between about 1:1 and 1:4.

In accordance with another embodiment of the apparatus of the present invention, the radially extending grooves in the first refining zones include a dam blocking the radially extending grooves, the dam comprising a maximum of one dam, and the radially extending grooves in the second refining zones are free of any dams. In a preferred embodiment, the radially extending grooves in the first refining zone and the radially extending grooves in the second refining zone are free of any dams.

BRIEF DESCRIPTION OF THE DRAWINGS

The present invention may be more fully appreciated with reference to the following detailed description, which, in turn, refers to the drawings in which.

DETAILED DESCRIPTION

Figure 2:
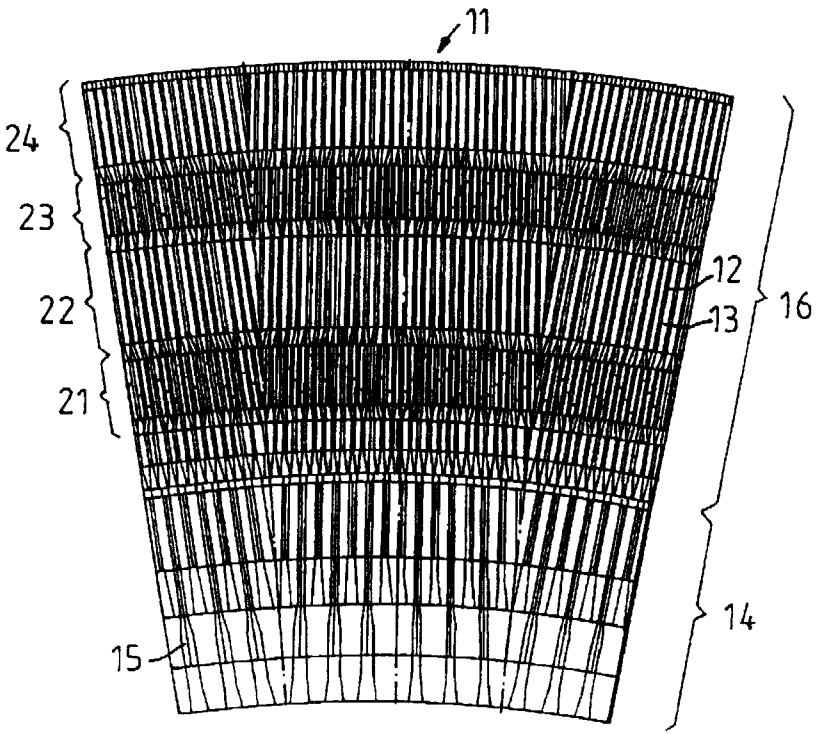
FIG. 2 is a top, elevational view of another refining element of a refining disk in accordance with the present invention.
Figure 1:
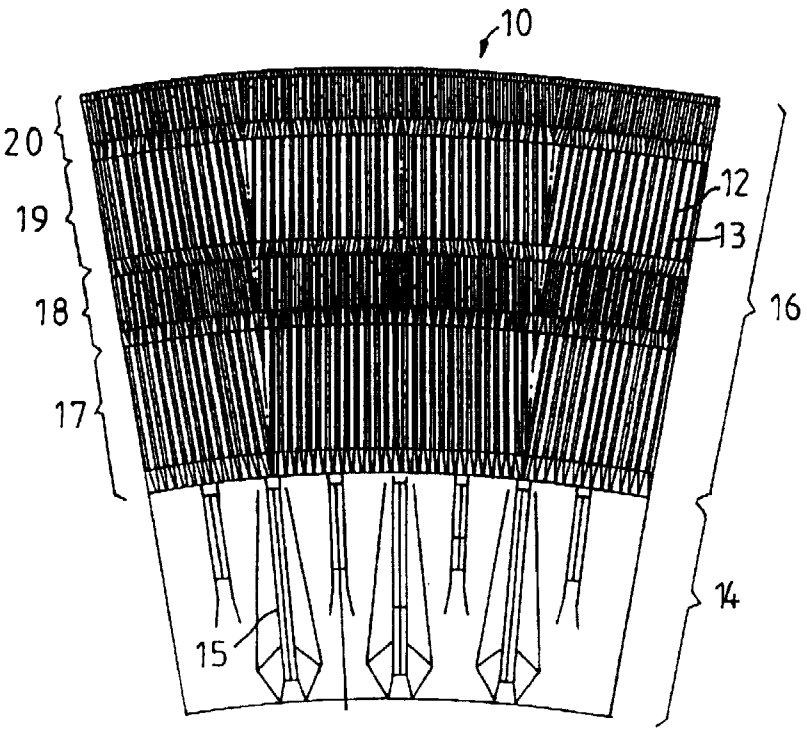
FIG. 1 is a top, elevational view of the surface of one refining element of a refining disk in accordance with the present invention.

A pair of co-operating opposed refining elements, 10 and 11, as shown in FIG. 1 and FIG. 2, respectively, carry a pattern of bars 12 and intermediate grooves 13, which extend substantially radially across the surface of the refining elements. The co-operating refining elements 10 and 11, are intended to define between themselves a refining gap. An inner portion 14 of these refining elements is provided with coarse bars 15, which are intended to carry out a first disintegration of the lignocellulose-containing material, and to feed it outwardly in the refining gap. An outer portion 16 of the refining elements, 10 and 11, is intended to form the portion of the refining gap proper in which disintegration and refining of the material take place.

The outer portion 16 of the refining elements, 10 and 11, is divided into a plurality of limited zones, 17–20 and 21–24, respectively, which are located radially outside of each other. The bars in these zones 17–24 are arranged alternatingly in denser or sparser relationships from one zone to an adjoining zone as one moves in the radial direction. The refining elements, 10 and 11, are formed so that a zone, 18 and 20 and 21 and 23, respectively, with a dense pattern of bars on a refining element is located directly in front of a zone, 22 and 24 and 17 and 19, respectively, with sparsely spaced bars on opposed co-operating refining elements. In addition grooves are preferably shallower in the more densely patterned zones and deeper in the more sparsely patterned zones.

In accordance with this arrangement, the fiber flow through the refining gap will be moved alternatingly over to the opposed refining element when the flow in a more sparsely patterned zone on one of the refining elements arrives at a more densely patterned zone. The demand for dams can hereby be reduced, and in certain cases eliminated entirely. The steam transport is also facilitated thereby, and the disturbing effect of the steam can be substantially decreased. As to the size of the zones, in order not to obstruct the fiber flow, the more densely patterned zones must be somewhat narrower than the adjoining more sparsely patterned zones.

The different zones in the outer portion 16 of the refining elements are preferably formed so that the width of the bars is substantially equal, while the spacing between the bars, i.e. the width of the grooves, varies. The ratio between the groove width in the more densely patterned zones 18, 20, 21 and 23, and the adjoining more sparsely patterned zones, 17, 19, 22 and 24, should be between about 1:1.25 and 1:1.75, preferably about 1:1.5. Suitable dimensions are a bar width of between about 1 and 3 mm and a groove width of between about 1 and 3 mm and a groove depth of between about 1 and 3 mm in the more densely patterned zones, and a bar width of between about 1 and 3 mm and a groove width of between about 1.5 and 5 mm in the more sparsely patterned zones.

As for the groove depth, the ratio between the zones should be between about 1:1 and 1:4. Suitable dimensions are a groove depth of between abut 2 and 5 mm in the more densely patterned zones and between about 5 and 8 mm in the adjoining more sparsely patterned zones.

The number of zones in the outer portion of the refining elements can be varied, but the refining elements are preferably formed with two more densely and two more sparsely patterned zones.

Dams can be excluded entirely, or they can be reduced in number, for example to one dam per groove in a more densely patterned zone.

It has thus been found possible, by utilizing this type of refining element, to produce pulp with a very low shives content, e.g. below about 0.15% at a freeness of 150 ml CSF, and with an increased tensile strength (tensile index) at a lower specific energy input. It has also been observed that the energy level was lowered by up to about 20%.

It has also been found possible to reduce the long fiber fraction (+30 mesh according to B. McNett) by about 10% to 15%, where the greatest part of that reduction applies to the fraction which is of +16 mesh. In certain cases, this can be particularly advantageous, for example, during the manufacture of magazine paper.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. Apparatus for refining lignocellulose-containing material in a disk refiner comprising a pair of opposed, relatively rotatable refining disks defining a refining gap for said lignocellulose-containing material therebetween, said pair of refining disks including at least one refining disk comprising a refining disk surface including an inner refining zone section and an outer refining zone section disposed radially outwardly with respect to said inner refining zone section, said outer refining zone section including a first refining zone, a second refining zone disposed outwardly with respect to said first refining zone, and a third refining zone disposed outwardly with respect to said second refining zone, each of said first, second and third refining zones including a plurality of radially extending bars separated by a corresponding plurality of radially extending grooves, with the ratio of said bars to said grooves defining a bar density for each of said refining zones, said second refining zone having a first predetermined bar density and each of said first and third refining zones having a second predetermined bar density which is different from said first predetermined bar density.

2. The apparatus of claim 1 wherein said second predetermined bar density is greater than said first predetermined bar density.

3. The apparatus of claim 2 wherein the ratio of the width of said grooves in said first and third refining zones to the width of said grooves in said second refining zone is between about 1:1.25 and 1:1.75.

4. The apparatus of claim 3 wherein said ratio of the width of said grooves in said first and third refining zones to the width of said grooves in said second refining zone is about 1:1.5.

5. The apparatus of claim 2 wherein said radially extending grooves in said first and third refining zones have a first depth and said radially extending grooves in said second refining zone have a second depth, said first depth being less than said second depth.

6. The apparatus of claim 5 wherein the ratio of said first depth to said second depth is between about 1:1 and 1:4.

7. The apparatus of claim 1 wherein said second predetermined bar density is less than said first predetermined bar density.

8. The apparatus of claim 7 wherein the ratio of the width of said grooves in said second refining zone to the width of said grooves in said first and third refining zones is between about 1:1.25 and 1:1.75.

9. The apparatus of claim 8 wherein the ratio of the width of said grooves in said second refining zone to the width of said grooves in said first and third refining zones is about 1:1.5.

10. The apparatus of claim 7 wherein said radially extending grooves in said first and third refining zones have a first depth and said radially extending grooves in said second refining zone have a second depth, said first depth being greater than said second depth.

11. The apparatus of claim 1 including a fourth refining zone disposed radially outwardly with respect to said third refining zone, said fourth refining zone having said first predetermined bar density.

12. The apparatus of claim 11 wherein said second predetermined density is greater than said first predetermined bar density.

13. The apparatus of claim 11 wherein said second predetermined bar density is less than said first predetermined bar density.

14. The apparatus of claim 1 wherein said radially extending grooves in said first and third refining zones include a dam blocking said radially extending grooves, said dam comprising a maximum of one dam, and wherein said radially extending grooves in said second refining zone are free of any dam.

15. The apparatus of claim 1 wherein said radially extending grooves in said first and third refining zones and said radially extending grooves in said second refining zone are free of any dams.

16. Apparatus for refining lignocellulose-containing material in a disk refiner comprising a pair of opposed relatively rotatable refining disks defining a refining gap for said lignocellulose-containing material therebetween, said pair of refining disks including a first refining disk and a second refining disk, said first refining disk including an inner refining zone section and an outer refining zone section disposed radially outwardly with respect to said inner refining zone section, said outer refining zone section of said first refining disk including a first refining zone and a second refining zone disposed outwardly with respect to said first refining zone, said outer refining zone section of said second refining disk including a first refining zone and a second refining zone disposed outwardly with respect to said first refining zone, each of said first and second refining zones of said first and second refining disks including a plurality of radially extending bars separated by a corresponding plurality of radially extending grooves defining a bar density for each of said refining zones, said first refining zones of said first and second refining disks having a first predetermined bar density and said second refining zone of said first and second refining disks having a second predetermined bar density, said first predetermined bar density being greater than said second predetermined bar density, and said first and second refining zones in said first refining disk being radially offset with respect to said first and second refining zones in said second refining disk so that said first refining zone in said first refining disk does not overlap with said first refining zone in said second refining disk.

17. The apparatus of claim 16 wherein the ratio between the width of said radially extending grooves in said first refining zones of said first and second refining disks to the width of said radially extending grooves in said second refining zones of said first and second refining disks is between about 1:1.25 and 1:1.75.

18. The apparatus of claim 17 wherein the ratio between the width of said radially extending grooves in said first refining zones of said first and second refining disks to the width of said radially extending grooves in said second refining zones of said first and second refining disks is about 1:1.5.

19. The apparatus of claim 16 wherein said radially extending grooves in said first refining zones of said first and second refining disks have a first depth, and said radially extending grooves in said second refining zones of said first and second refining disks have a second depth, said first depth being less than said second depth.

20. The apparatus of claim 19 wherein the radio between said first depth and said second depth is between about 1:1 and 1:4.

21. The apparatus of claim 16 wherein said radially extending grooves in said first refining zones include a dam blocking said radially extending grooves, said dam comprising a maximum of one dam, and wherein said radially extending grooves in said second refining zones are free of any dams.

22. The apparatus of claim 16 wherein said radially extending grooves in said first refining zones and said radially extending grooves in said second refining zones are free of any dams.

* * * * *

UNITED STATES PATENT AND TRADEMARK OFFICE

CERTIFICATE OF CORRECTION

PATENT NO. : 5,695,136

DATED : December 9, 1997

INVENTOR(S) : Lennart Rohdén and Lars Obitz

It is certified that error appears in the above-identified patent and that said Letters Patent is hereby corrected as shown below:

Column 4, line 10, after "addition" insert --,--.
Column 4, line 41, delete "abut" and insert therefor --about--.
Column 4, line 49, after "example" insert --,--.
Column 6, line 54, delete "radio" and insert therefor --ratio--.

Signed and Sealed this

Fourteenth Day of April, 1998

Bruce Lehman

*Attest:*

BRUCE LEHMAN

*Attesting Officer*

*Commissioner of Patents and Trademarks*